US008490706B2

(12) United States Patent
Rodgers

(10) Patent No.: US 8,490,706 B2
(45) Date of Patent: Jul. 23, 2013

(54) CASING HEAD CONNECTOR

(75) Inventor: Doyle W. Rodgers, Longview, TX (US)

(73) Assignee: Stream-Flo Industries Ltd., Edmonton (CA)

( * ) Notice: Subject to any disclaimer, the term of this patent is extended or adjusted under 35 U.S.C. 154(b) by 0 days.

(21) Appl. No.: 12/862,479

(22) Filed: Aug. 24, 2010

(65) Prior Publication Data

US 2011/0042065 A1 Feb. 24, 2011

Related U.S. Application Data

(60) Provisional application No. 61/236,383, filed on Aug. 24, 2009.

(51) Int. Cl.
*E21B 33/04* (2006.01)

(52) U.S. Cl.
USPC ..... 166/379; 166/75.13; 166/85.1

(58) Field of Classification Search
USPC ..... 166/378, 379, 380, 381, 382, 77.51, 166/85.1, 85.5, 75.13, 89.1, 89.3
See application file for complete search history.

(56) References Cited

U.S. PATENT DOCUMENTS

| | | | | |
|---|---|---|---|---|
| 1,367,156 | A * | 2/1921 | McAlvay et al. | 166/75.13 |
| 1,863,890 | A * | 6/1932 | Wigle | 166/89.3 |
| 2,306,102 | A * | 12/1942 | Penick et al. | 277/328 |
| 2,312,476 | A * | 3/1943 | Penick et al. | 285/123.9 |
| 2,383,248 | A * | 8/1945 | Garrett | 285/123.7 |
| 2,417,181 | A * | 3/1947 | Sandilands | 285/123.7 |
| 2,962,096 | A | 11/1960 | Knox | |
| 3,228,715 | A | 1/1966 | Neilon et al. | |
| 4,239,266 | A * | 12/1980 | Mynhier | 285/323 |
| 4,304,424 | A | 12/1981 | Hansen | |
| 4,335,312 | A * | 6/1982 | Onken | 378/26 |
| 4,413,845 | A * | 11/1983 | Lawrence | 285/23 |
| 4,453,745 | A * | 6/1984 | Nelson | 285/18 |
| 4,799,714 | A | 1/1989 | Collet | |
| 4,856,594 | A * | 8/1989 | Jennings | 166/338 |
| 4,936,382 | A | 6/1990 | Thomas | |
| 4,971,146 | A * | 11/1990 | Terrell | 166/55 |
| 5,135,266 | A * | 8/1992 | Bridges et al. | 285/123.7 |
| 5,158,326 | A | 10/1992 | Anderson et al. | |
| 5,205,356 | A | 4/1993 | Bridges et al. | |

(Continued)

FOREIGN PATENT DOCUMENTS

CA 2015966 1/1991

OTHER PUBLICATIONS

International Search Report and Written Opinion of the ISA mailed Jan. 4, 2011.

(Continued)

*Primary Examiner* — Shane Bomar
*Assistant Examiner* — Wei Wang
(74) *Attorney, Agent, or Firm* — Lathrop & Gage LLP

(57) ABSTRACT

A wellhead connection to casing is formed from an upper head housing, a slip bowl housing and slip segments. First compression spring extending vertically between slip segment and the a slip bowl housing, and second compression springs extending generally horizontally between adjacent slip segments maintain the slip segments out of gripping engagement with the casing until the slip bowl housing and the upper head housing are fully connected together. On disconnecting the housings, the first compression springs push the slip segments apart from the slip bowl housing, and the second compression springs push the slip segments radially apart from the casing.

10 Claims, 2 Drawing Sheets

U.S. PATENT DOCUMENTS

| | | | | |
|---|---|---|---|---|
| 5,299,644 | A * | 4/1994 | Eckert | 166/379 |
| 5,309,991 | A * | 5/1994 | Watkins | 166/75.14 |
| 5,332,043 | A | 7/1994 | Ferguson | |
| 5,727,631 | A * | 3/1998 | Baker et al. | 166/379 |
| 5,899,507 | A | 5/1999 | Schroeder | |
| 5,947,527 | A * | 9/1999 | Carter | 285/4 |
| 6,192,981 | B1 * | 2/2001 | Boquet et al. | 166/75.13 |
| 6,311,792 | B1 * | 11/2001 | Scott et al. | 175/162 |
| 6,755,293 | B2 * | 6/2004 | Jensen et al. | 192/45.1 |
| 6,820,705 | B2 * | 11/2004 | Baugh | 175/423 |
| 6,834,718 | B2 | 12/2004 | Webster | |
| 6,948,904 | B2 * | 9/2005 | Bunn et al. | 414/729 |
| 6,952,094 | B1 * | 10/2005 | Viertl | 324/238 |
| 6,983,960 | B2 * | 1/2006 | Svetlik | 285/337 |
| 7,188,689 | B2 * | 3/2007 | Maxwell et al. | 175/325.3 |
| 7,207,606 | B2 * | 4/2007 | Owen et al. | 285/339 |
| 2003/0183473 | A1 * | 10/2003 | Jensen et al. | 192/45.1 |
| 2003/0227187 | A1 * | 12/2003 | Bunn | 294/88 |
| 2006/0103076 | A1 * | 5/2006 | Hashimoto | 277/562 |
| 2007/0152445 | A1 * | 7/2007 | Niven et al. | 285/411 |
| 2008/0115972 | A1 * | 5/2008 | Lynde et al. | 175/57 |
| 2009/0014184 | A1 * | 1/2009 | Voss et al. | 166/345 |
| 2009/0120648 | A1 * | 5/2009 | Khazanovich et al. | 166/379 |
| 2011/0030974 | A1 * | 2/2011 | Nguyen | 166/382 |

OTHER PUBLICATIONS

International Preliminary Report on Patentability, dated Feb. 28, 2012, corresponding to International Application No. PCT/CA2010/001290 (filed Aug. 24, 2010), parent of the present application, 6 pp.

* cited by examiner

CASING HEAD CONNECTOR

CROSS-REFERENCE TO RELATED APPLICATION

This application claims priority from U.S. Provisional Patent Application No. 61/236,383 filed Aug. 24, 2009, which is incorporated by reference herein in its entirety to the extent that there is no inconsistency with the present disclosure.

BACKGROUND OF THE INVENTION

This invention relates to a wellhead connector and a method of connecting a wellhead connector to a casing.

The lower part of a wellhead is called a casing head or tubing head, hereafter termed casing head. The casing head is attached to a casing (tubular pipe) and provides a connection at its upper end to the wellhead equipment located there above. The connection must be able to seal well pressure and transmit mechanical loads in any direction. Common connections to a casing are either by threading or by welding. The problems with these methods of attaching the casing head are that they may require extensive time and labour, are often expensive, and create the possibility of installation errors. Also, experienced welders may not be available at the well site.

Another method is to attach the casing head using a means for gripping the casing pipe with mechanically activated teeth. A seal between the casing head and the casing pipe is then provided separately, usually in the form of an elastomeric seal ring (for example an O-ring) located in the casing head above a mechanical gripping mechanism. Such an assembly is well known in the industry and is described in, for example, U.S. Pat. No. 4,799,714 issued to Collet, U.S. Pat. No. 5,332,043 issued to Ferguson, and Canadian Patent 2,015,966 issued to Anderson et al. Each of these patents describes a known method for mechanically attaching the casing head to the surface casing. These patents disclose the use of conical slip segments which surround the casing pipe, each slip segment being provided with a plurality of grooves on their straight inside surface (casing pipe-contacting surface) that act as teeth that bite into the outer surface of the casing. A slip housing, or actuation sleeve, with a conical mating surface to the conical surface on the outside of the slip segments is driven against the slip segments (or the slip segments are driven against the slip housing/sleeve). This forces the slip segments against the surface casing pipe causing the grooves to frictionally grip (or the teeth to bite into) the casing pipe, and thus to secure the casing pipe to the casing head. These slip segments are commonly referred to as "slips" and the system is commonly described as a slip lock casing connector, or slip connector.

A slip lock casing connector has advantages over the previously described casing connectors. These include reduced installation time compared to welding, and unlike a threaded connection, proper orientation of the head can be achieved.

Other casing head connections for oil and gas wellheads can be seen in the following U.S. Pat. No. 4,239,266 to Mynhier; U.S. Pat. No. 4,304,424 to Hanson; U.S. Pat. No. 4,936,382 to Thomas; U.S. Pat. Nos. 5,135,266; 5,158,326 to Anderson et al.; U.S. Pat. No. 5,205,356 to Bridges et al.; U.S. Pat. No. 5,299,644 to Ekert; U.S. Pat. No. 5,899,507 to Schroeder et al.; and U.S. Pat. No. 6,834,718 to Webster.

SUMMARY OF THE INVENTION

In the embodiment of the Figures, the wellhead connection is shown as a casing head connected to a surface casing (for example), but the invention has broad application to other wellhead connections in which slip connectors may be used to connect to a tubular pipe. Thus the terms "casing" as used herein and in the claims is meant to include any tubular pipe, such as surface casing, production casing, production tubing, or conductor pipe. The term "casing head" is used in the illustrated embodiment as exemplary of any pressure-containing wellhead member, such as a tubing head or the like, and it is meant to include these alternatives.

Broadly stated, there is provided a wellhead connection for connecting and sealing to a casing, the wellhead connection including a tubular upper head housing, a annular slip bowl housing and a plurality of slip segments. The upper head housing has a top connector to connect to wellhead equipment located there above, a bottom flange connector formed with a plurality of vertical ports, an inner bore to accommodate the upper portion of the casing, and a seal profile section in the inner bore. One or more seals in the seal profile seal to the casing when the upper head housing is installed over the casing. The slip bowl housing is adapted to be positioned around the upper portion of the casing for connection below the upper head housing. The slip bowl housing is formed with a plurality of vertical apertures adapted to be aligned with the vertical ports of the bottom flange connector of the upper head housing. A plurality of threaded connectors, for example cap screws, extend through the vertical ports in the bottom flange connector of the upper head housing and into the vertical ports in the slip bowl housing. The plurality of slip segments are adapted to be positioned within the slip bowl housing around the casing for gripping the outer wall of the casing when mechanically engaged in the slip bowl housing on connecting the upper head housing and the slip bowl housing with the threaded connectors. The slip segments are formed with an upper flange connector. One or both of two sets of compression springs (first and second compression springs) are provided. First compression springs are adapted to positioned generally vertically between the upper surface of the slip bowl housing and the lower surface of the upper flange connector of the slip segments. Second compression springs are adapted to be positioned generally horizontally between adjacent of the slip segments. On connecting the slip bowl housing and the upper head housing, with the threaded connectors tightened, the slip segments are energized into gripping engagement with the casing and the slip bowl and upper head housings are locked around the casing. On disconnecting the threaded connectors the first compression springs push the slip segments apart from the slip bowl housing, and the second compression springs push the slip segments radially apart from the casing.

Also provided is a method of connecting a wellhead connector to an upper portion of a casing. The method includes assembling in sequence bottom to top, the annular slip bowl housing, the plurality of slip segments and the upper head housing. The plurality of slip segments are maintained spaced from the slip bowl housing by one or both of the steps of:

spacing the plurality of slip segments vertically apart from slip bowl housing with a plurality of first compression springs positioned generally vertically between the upper surface of the slip bowl housing and the lower surface of the upper flange connector of the slip segments; and spacing adjacent slip segments horizontally apart from each other with a plurality of second compression springs positioned generally horizontally between adjacent of the plurality of slip segments.

The method further includes:

connecting together the assembled slip bowl housing and upper head housing with a plurality of threaded connectors extending through the vertical ports of the upper head housing and the vertical apertures of the slip bowl housing;

installing the assembled and connected slip bowl housing and upper head housing over the upper portion of the casing; and tightening the plurality of threaded connectors to energize the slip segments into gripping engagement with the casing and to lock the slip bowl housing and upper head housing around the casing;

such that on disconnecting the plurality of threaded connectors, the first compression springs, if present, push the slip segments vertically apart from the slip bowl housing, and the second compression springs, if present, push the slip segments radially apart from the casing.

DETAILED DESCRIPTION OF THE INVENTION

Figure 1:
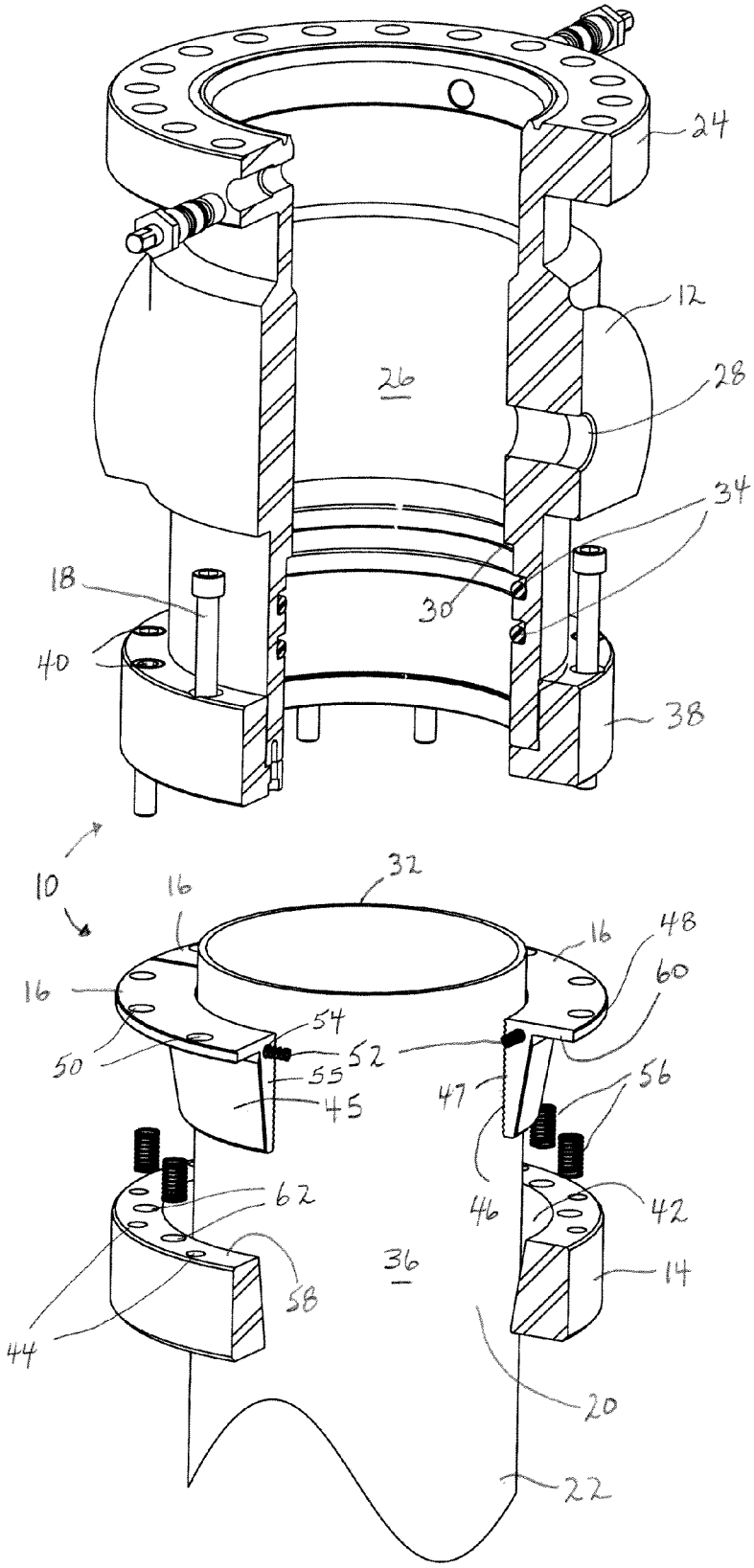
FIG. 1 is a top perspective view showing the components of the wellhead head connector as a casing head connector, in exploded condition, and partially cutaway, for connection to a casing.
Figure 2:
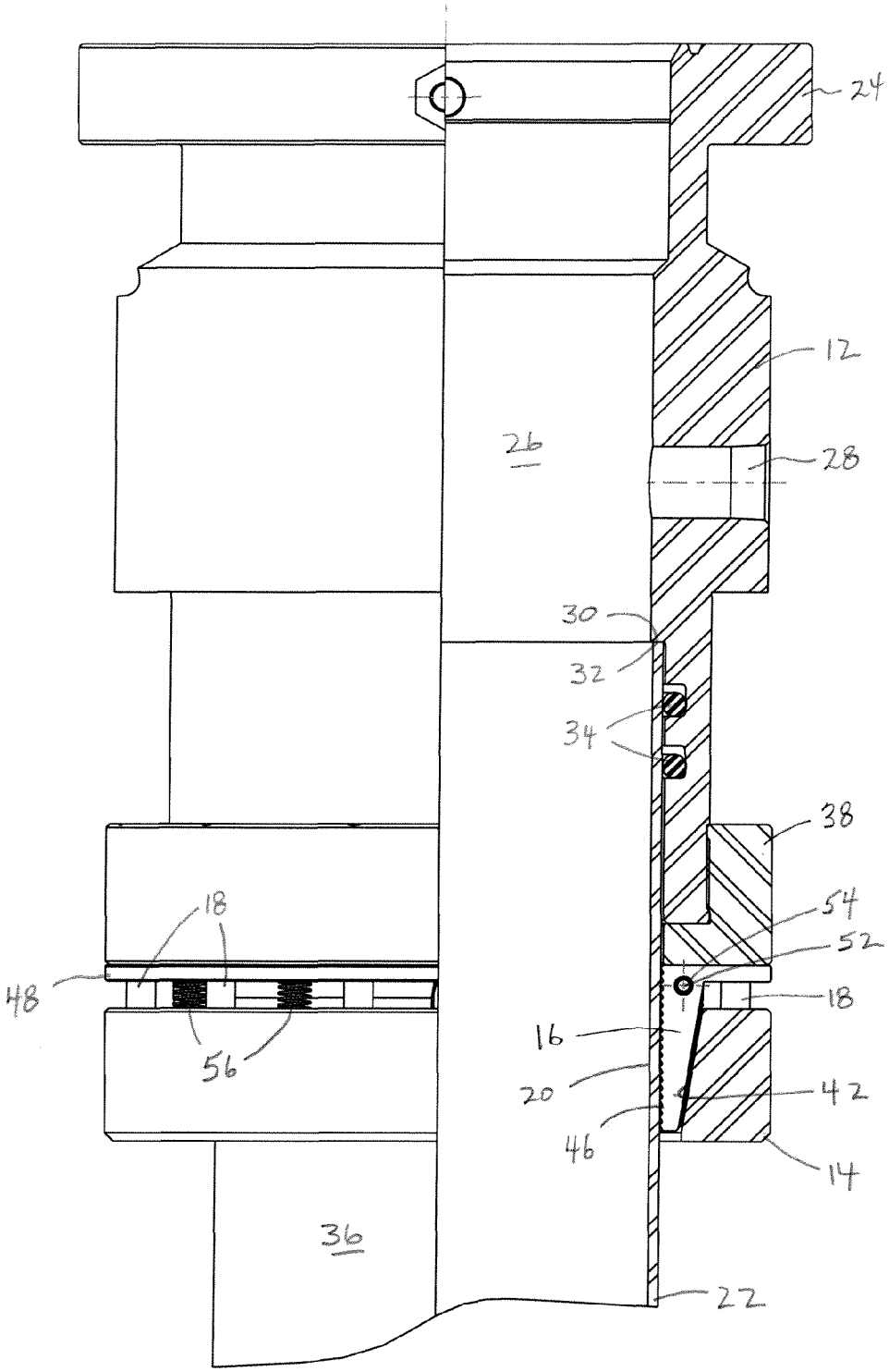
FIG. 2 is a partial sectional view of the casing head connector of FIG. 1, with the components in their connected condition on the upper portion of the casing.

A wellhead connection in the form of a casing head connector 10 is shown in the FIGS. 1, 2. The casing head connector 10 is formed with an upper head housing 12, a lower slip bowl housing 14, and a plurality of slip segments 16. The components 12, 14, 16 are connected together with threaded connectors 18 in a manner such that the slip segments 16 are maintained in spaced relationship from the slip bowl housing 14, as more fully described below. The assembled and connected components 12, 14, 16 are then installed over the upper portion 20 of casing 22. The threaded connectors are tightened to energize the slip segments 16 into gripping engagement with the casing and to lock the slip bowl housing 14 and the upper head housing 12 around casing 22.

The upper head housing 12, is shown to be a pressure containing spool with a top flange connector 24 (shown as a stud/nut connection) to make a sealed connection to wellhead equipment to be located there above. Alternate top connectors may be used, for example threaded, welded or hub connections. The upper head housing 12 forms an inner or central bore 26 to accommodate the upper portion 20 of the casing 22. The upper head housing 12 may include side ports 28. An inwardly projecting stop shoulder or load shoulder 30 may be formed in the inner bore 26 to allow the upper head housing 12 to rest on the upper end 32 of the casing 22. One or more seals 34 (example O-rings) are provided in the central bore 26 below the stop shoulder 30 to seal to the outer surface 36 of the casing 22. Alternate seals to the casing 22 may be used, as known in the art.

The upper head housing 12 includes a bottom flange connector 38 formed with vertical ports 40 adapted to receive cap screws 18 (or bolts/nut connectors or other threaded connectors) for connection to the lower slip bowl housing 14, as set out more fully below. In the Figures, the bottom flange connector 38 is formed as a threaded flange, threaded onto the lower end of the upper head housing 12. However, it will be understood that the bottom flange connector 38 may be formed as an integral flange.

The slip bowl housing 14 is an annular ring component forming a tapered (conical) inner bore 42 and is adapted to slide over the upper portion 20 of the casing 22. The slip bowl housing 14 is formed with threaded vertical apertures 44 (or ports for bolt/nut connectors) adapted to align with vertical ports 40 and to receive cap screws 18 extending from the upper head housing 12.

Slip segments 16 (two or more) have an outer conical taper surface 45 (reverse to the taper of the inner bore 42 of the slip bowl housing 14) on their outer surface, inwardly projecting teeth or threads or other gripping members 47 at their inner bore 46 for gripping engagement with the outer surface 36 of the casing 22, and an upper flange connector 48 formed with through holes 50 to receive the cap screws 18 extending from the upper head housing 12.

In the unconnected condition, the slip segments 16 are preferably held radially apart (horizontally apart) from each other, and radially spaced from the casing 22 by horizontal compression springs 52 (ex. coil springs) extending generally horizontally between adjacent slip segments 16 (at least one spring 52 per slip segment 16). Each compression spring 52 is held in apertures 54 formed in the facing walls 55 of the adjacent segments 16. The compression springs 52 compress when the cap screws 18 are fully engaged (tightened) between the housings 12, 14 to mechanically actuate the slip segments 16, allowing the slip segments 16 to move radially inwardly to grip the casing 22.

In the unconnected condition, vertical compression springs 56 (ex. coil springs) are positioned generally vertically between the upper surface 58 of the slip bowl housing 14 and the lower surface 60 of the upper flange connector 48 of the slip segments 16 to maintain the slip segments 16 vertically spaced apart from the slip bowl housing 14. The springs 56 are preferably held in position by blind apertures 62 formed in the upper surface 58 of the slip bowl housing 14. The springs 56 compress when the cap screws 18 are fully engaged (tightened) between the housings 12, 14, allowing the slip segments 16 to move radially inwardly to grip the casing 22.

The casing head connector 10 as above-described, functions to mechanically engage and lock to casing 22. The connector 10 also seals to the outer surface 36 of the casing 22. The cap screws 18 are connected through the aligned ports 40, 44 of the upper housing 12 and the slip bowl housing 14 and through the through holes 50 of the slip segments 16, such that the upper housing 12 engages the slip bowl housing 14, which in turn acts against the taper on the back of the slip segments 16, forcing them inwardly to grip the outer surface 36 of the casing 22.

When the housings 12, 14 are disconnected, the springs 52, 56 engage the slip segments 16, forcing the slip segments 16 vertically upwardly, away from the slip bowl housing 14, and radially outwardly from each other (apart) to allow the connector 10 to be easily removed from the casing 22 after the cap screws 18 are released. While both sets of springs 52, 56 are advantageous, the casing head connector 10 may be used with either or both sets of the springs 52, 56. The number and rate of the compression springs 52, 56 is sufficient to overcome at least the weight of the slip segments 16.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements. For example, the term "a seal" as used herein and in the claims may include multiple seals.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

I claim:

1. A wellhead connection for connecting and sealing to a casing, the casing having an outer wall, an upper portion and an upper end, the wellhead connection comprising:

a generally tubular, pressure-containing upper head housing having a top connector adapted to connect to wellhead equipment located there above, a bottom flange connector formed with a plurality of vertical ports, an inner bore adapted to accommodate the upper portion of the casing, and the inner bore having a seal profile section;

a seal adapted to seal the seal profile section of the inner bore to the outer surface of the casing when the upper head housing is lowered over the casing;

an annular slip bowl housing adapted to be positioned around the upper portion of the casing for connection below the upper head housing, the slip bowl housing having an upper surface, and the slip bowl housing being formed with a plurality of vertical apertures adapted to be aligned with the vertical ports of the bottom flange connector of the upper head housing;

a plurality of threaded connectors adapted to extend through the vertical ports in the bottom flange connector of the upper head housing and into the vertical ports in the slip bowl housing;

a plurality of slip segments adapted to be positioned within the slip bowl housing around the casing for gripping the outer wall of the casing when mechanically engaged in the slip bowl housing on connecting the upper head housing and the slip bowl housing with the threaded connectors, each of the plurality of slip segments being formed with an upper flange connector having a lower surface; and one or both of:

a plurality of first compression springs, each of the plurality of compression springs being adapted to be positioned generally vertically between the upper surface of the slip bowl housing and the lower surface of the upper flange connector of each of the plurality of slip segments to maintain the plurality of slip segments vertically spaced apart from the slip bowl housing before the threaded connectors are tightened, and to compress when the slip bowl housing and the upper head housing are connected by tightening the threaded connectors so as to allow the plurality of slip segments to move radially inwardly to grip the casing; and a plurality of second compression springs, each of the plurality of compression springs being adapted to be positioned generally horizontally between adjacent of the plurality of slip segments to maintain the plurality of slip segments radially apart from each other and radially spaced from the casing before the threaded connectors are tightened, and to compress when the slip bowl housing and the upper head housing are connected by tightening the threaded connectors so as to allow the plurality of slip segments to move radially inwardly to grip the casing;

such that, on connecting the slip bowl housing and the upper head housing with the threaded connectors tightened, the slip segments are energized into gripping engagement with the outer surface of the casing, locking the slip bowl housing and the upper head housing around the upper portion of the casing, and on disconnecting the threaded connectors the first compression springs, if present, push the slip segments apart from the slip bowl housing, and the second compression springs, if present, push the slip segments radially apart from the casing.

2. The wellhead connection of claim 1, which comprises both the plurality of first compression springs and the plurality of second compression springs.

3. The wellhead connection of claim 2, wherein the threaded connectors are cap screws or bolt and nut connectors extending between the bottom flange connector of the upper head housing and the slip bowl housing.

4. The wellhead connection of claim 2, wherein the upper flange connector of each of the plurality of slip segments is formed with one or more through holes for the threaded connectors to pass through.

5. The wellhead connection of claim 2, wherein the upper surface of the slip bowl housing is formed with a plurality of apertures to hold the first compression springs in position between the slip bowl housing and the bottom flange connector of the upper head housing.

6. The wellhead connection of claim 2, wherein each of the plurality of slip segments is formed with horizontal apertures adapted to hold the second compression springs in position between adjacent slip segments.

7. The wellhead connection of claim 2, wherein a stop shoulder is formed in the inner bore of the upper head housing above the seal profile section to allow the upper head housing to rest on the upper end of the casing.

8. A method of connecting a wellhead connector to an upper portion of a casing, the casing having an upper end and an outer surface, the method comprising:

(i) assembling in sequence bottom to top, an annular slip bowl housing, a plurality of slip segments and an upper head housing, wherein:

the upper head housing has a bottom flange connector formed with a plurality of vertical ports, an inner bore to accommodate the upper portion of the casing, and one or more seals located in a seal profile section of the inner bore, the one or more seals being adapted to seal the seal profile section of the inner bore to the outer surface of the casing when the upper head housing is lowered over the casing;

the slip bowl housing has an upper surface and is formed with a plurality of vertical apertures aligned with the vertical ports of the bottom flange connector of the upper head housing;

each of the plurality of slip segments is formed with grip engaging members at an inner bore and with an upper flange connector having a lower surface;

(ii) maintaining the plurality of slip segments spaced from the slip bowl housing and from the casing by one or both of the steps of:

spacing the plurality of slip segments vertically apart from the slip bowl housing with a plurality of first compression springs, each of the plurality of compression springs being positioned generally vertically between the upper surface of the slip bowl housing and the lower surface of the upper flange connector of each of the plurality of slip segments; and spacing adjacent slip segments horizontally apart from each other and radially spaced from the casing with a plurality of second compression springs, each of the plurality of second compression springs being positioned generally horizontally between adjacent of the plurality of slip segments;

(iii) connecting together the assembled slip bowl housing and upper head housing with a plurality of threaded connectors extending through the vertical ports of the upper head housing and the vertical apertures of the slip bowl housing;

(iv) installing the assembled and connected slip bowl housing and upper head housing over the upper portion of the casing to seal the seal profile section of the inner bore to the casing; and (v) tightening the plurality of threaded connectors to energize the slip segments into gripping engagement with the casing and to lock the slip bowl housing and upper head housing around the casing;

such that, on disconnecting the plurality of threaded connectors, the first compression springs, if present, push the slip segments vertically apart from the slip bowl housing, and the second compression springs, if present, push the slip segments radially apart from the casing.

9. The method of claim 8, wherein both the plurality of first compression springs and the plurality of the second compression springs are included.

10. The method of claim 9, wherein:

the upper flange connector of each of the plurality of slip segments is formed with one or more through holes for the threaded connectors to pass through;

the threaded connectors are cap screws or bolt and nut connectors extending between the bottom flange connector of the upper head housing and the slip bowl housing;

each of the first compression springs is held in an aperture formed in the upper surface of the slip bowl housing;

each of the second compression springs is held at its ends in horizontal apertures formed in adjacent of the plurality of slip segments; and a stop shoulder is formed in the inner bore of the upper head housing above the seal profile section to allow the upper head housing to rest on the upper end of the casing.

* * * * *